United States Patent [19]

Forshaw

[11] Patent Number: 4,750,588

[45] Date of Patent: Jun. 14, 1988

[54] LOAD-HANDLING APPARATUS

[75] Inventor: Kenneth E. Forshaw, Manchester, United Kingdom

[73] Assignee: Didsbury Engineering Company Limited

[21] Appl. No.: 887,082

[22] PCT Filed: Oct. 10, 1985

[86] PCT No.: PCT/GB85/00455

§ 371 Date: Jun. 17, 1986

§ 102(e) Date: Jun. 17, 1986

[87] PCT Pub. No.: WO86/02342

PCT Pub. Date: Apr. 24, 1986

[30] Foreign Application Priority Data

Oct. 19, 1984 [GB] United Kingdom ..... 8426432

[51] Int. Cl.[4] ..... B66F 9/22; B66F 9/12

[52] U.S. Cl. ..... 187/9 E; 187/9 R; 254/124; 414/718; 414/728

[58] Field of Search ..... 414/718, 728, 589, 685, 414/785, 910, 911; 254/8 R, 124; 187/9 R, 17, 9 E; 91/520; 89/46

[56] References Cited

U.S. PATENT DOCUMENTS

| | | | |
|---|---|---|---|
| 2,454,840 | 11/1948 | Ryan | 414/917 X |
| 2,613,822 | 10/1952 | Stanley | 414/728 |
| 2,625,279 | 1/1953 | Dalby et al. | 254/124 X |
| 2,698,106 | 12/1954 | McElhinney et al. | 414/718 |
| 2,729,406 | 1/1956 | Bush | 254/8 R X |
| 2,940,611 | 6/1960 | Burch | 414/728 |
| 3,087,630 | 4/1963 | Karnow et al. | 414/728 X |
| 3,184,920 | 5/1965 | Lohbauer et al. | 91/520 X |
| 3,476,016 | 11/1969 | Dixon et al. | 91/520 |
| 3,758,076 | 9/1973 | Tranchero | 254/8 R |
| 4,467,894 | 8/1984 | Sinclair | 187/9 R X |
| 4,549,845 | 10/1985 | Ramsey, Jr. | 414/728 X |

FOREIGN PATENT DOCUMENTS

| | | | |
|---|---|---|---|
| 2919795 | 11/1980 | Fed. Rep. of Germany | 414/718 |
| 2028984 | 3/1980 | United Kingdom | 89/46 |
| 1590709 | 6/1981 | United Kingdom | 414/718 |

*Primary Examiner*—Joseph J. Rolla
*Assistant Examiner*—Nils E. Pedersen
*Attorney, Agent, or Firm*—Spensley Horn Jubas & Lubitz

[57] ABSTRACT

A load-handling apparatus usable for mounting missiles on an aircraft comprises a low wheeled support frame provided with braking and steering facilities, a pair of separate, side-by-side cranked support arms pivoted at one end on the support frame and hydraulically linked for synchronized vertical movement relative to the support frame about a horizontal axis, and load engaging structure at the other end of each support arm. Each cranked support arm is double cranked, so that, in a side elevation, it has a stretched, flat-bottomed V-configuration and the arms are movable about a common horizontal pivot axis on the support frame by an hydraulic actuator, whereby the hydraulic fluid serves to couple the support arms together for synchronized movements. The hydraulic actuator includes a master hydraulic cylinder connecting the support frame and one support arm and a sleeve hydraulic cylinder connecting the support frame and the other support arm.

15 Claims, 4 Drawing Sheets

LOAD-HANDLING APPARATUS

This invention relates to load-handling apparatus and is especially but not exclusively concerned with such apparatus for presenting missiles to the underside of the fuselage and the wings of an aircraft for attachment to missile mounting points thereon.

The problems involved in designing a load handling trolley include, inter alia, the requirement that the apparatus must be able easily and readily to engage and lift the missile off its transport racking, which is used to convey it from the armoury to the aircraft, the requirement that the apparatus must be able to present the missile in correct orientation to the aircraft, i.e. vertical approach of the horizontal missile to the underside of the fuselage, and a 45° approach to the wing pylons, the requirement that the apparatus must be able to manoeuvre under the aircraft without risk of damage to the aircraft or undercarriage of same, and the requirement that the apparatus must be capable of presenting the missile to the wing pylon stations without interference or damage to a large diameter fuel tank supported on the wing pylon.

It is an object of the present invention to provide a load-handling apparatus which satisfies these requirements.

According to the present invention there is provided a load-handling apparatus comprising a low support frame, a pair of separate, side-by-side cranked support arms pivoted at one end on the support frame and hydraulically linked for synchronised vertical movement relative to the support frame about a horizontal axis, and load engaging means at the other end of each support arm.

Preferably the support frame is substantially U-shaped in plan view. It is preferably wheelmounted for ease of movement (castor wheels being preferred). It is preferably provided with brake means to immobilise it during a load lifting operation (a pair of floor brakes are preferred). Finally, it is preferably provided with at least one but probably two steering handles which may be detachable.

Each cranked support arm is double cranked so that in side elevation it has a stretched flat-bottomed V-configuration.

The support arms are preferably movable about a common horizontal pivot axis on the support frame by hydraulic actuating means, whereof the hydraulic fluid serves to couple the support arms together for synchronised movements.

Preferably, the hydraulic actuating means is a master hydraulic cylinder connecting the support frame and one support arm and a slave hydraulic cylinder connecting the support frame and the other support arm.

Preferably, each load engaging means is a support head carried by a slidable extension of each support arm and adapted partially to embrace a load.

Each support head is preferably of semioctagonal configuration with retaining straps.

Preferably each support arm and its extension is connected by a levelling or trimming hydraulic cylinder, which cylinders are independently adjustable to level or trim the disposition of the support heads for correct presentation of the load.

The cylinders (master, slave and levelling) are preferably connected to a self-contained pump and hydraulic fluid reservoir on the support frame by convenient piping which includes selector valves for delivering hydraulic fluid respectively to the master and slave cylinders and to the levelling cylinders when required.

The pump preferably has a pressure relief valve for cylinder retraction. The pump is preferably manually operable.

It is desirable to provide a facility for fine angular adjustment which, with the aforesaid horizontal trimming facility, allows for compensation of aircraft attitude variations. It is also desirable to have a horizontal traverse facility for fuel engagement of the missiles.

With this in mind, each support head preferably incorporates rolling means to permit rotational and/or longitudinal movements of the load relative to the support heads by an operator. In the case of a missile this may be necessary to permit correct alignment of the complementary mounting points on the missile and the aircraft.

The rolling means may be ball transfer units.

Alternatively, each support head may have a subsidiary support head rotatably supported thereon by rollers, which subsidiary support frame presenting rollers on which the load is supported, there being adjustment screw means between the support arm and the subsidiary support head to permit rotational movement of the latter and its load for position adjustment purposes.

It is also visualised that longitudinal screw adjustment of the subsidiary support heads may be incorporated in the apparatus.

It is to be clearly understood that while the present invention is primarily concerned with a load handling apparatus for presenting missiles to aircraft for attachment thereto it can be adapted for other industrial load handling operations, and the most likely adaption is the replacement of the aforesaid support heads by other load manipulating means.

An embodiment of the present invention will now be described, by way of example, with reference to the accompanying drawings, in which.

Figure 1:
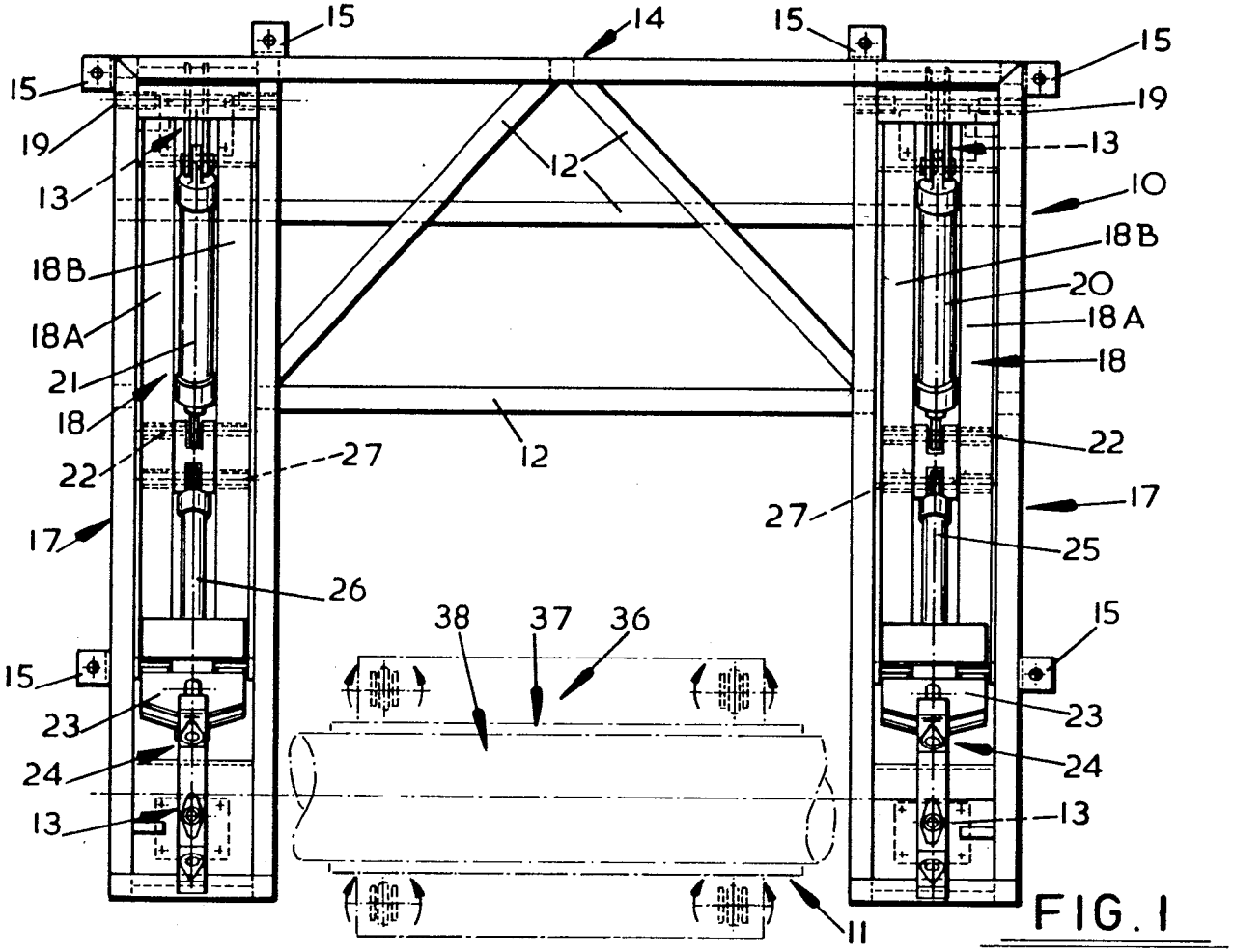
FIG. 1 is a plan view of the load-handling apparatus according to the invention.
Figure 2:
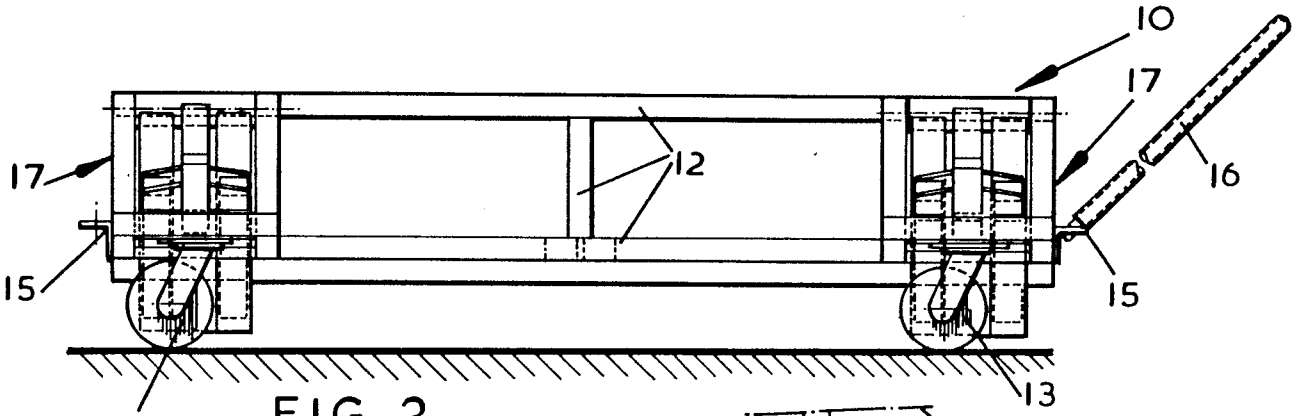
FIG. 2 is a corresponding front elevation.

The load-handling apparatus comprises a low-lying (i.e. ground adjacent) support frame 10 rectangular in plan view with an open side 11 so that it is of squared-off U-configuration in plan view. It is formed of tube (preferably square tube) with cross bracing 12.

The support frame 10 mounts at each corner a castor wheel 13 with a four-way directional lock. At its closed end 14, at each corner adjacent each castor wheel 13 is a floor brake (not shown) of conventional construction.

At each side the support frame 10 has two attachment points 15 with each pair being adapted detachably to receive a steering handle 16.

Figure 3:
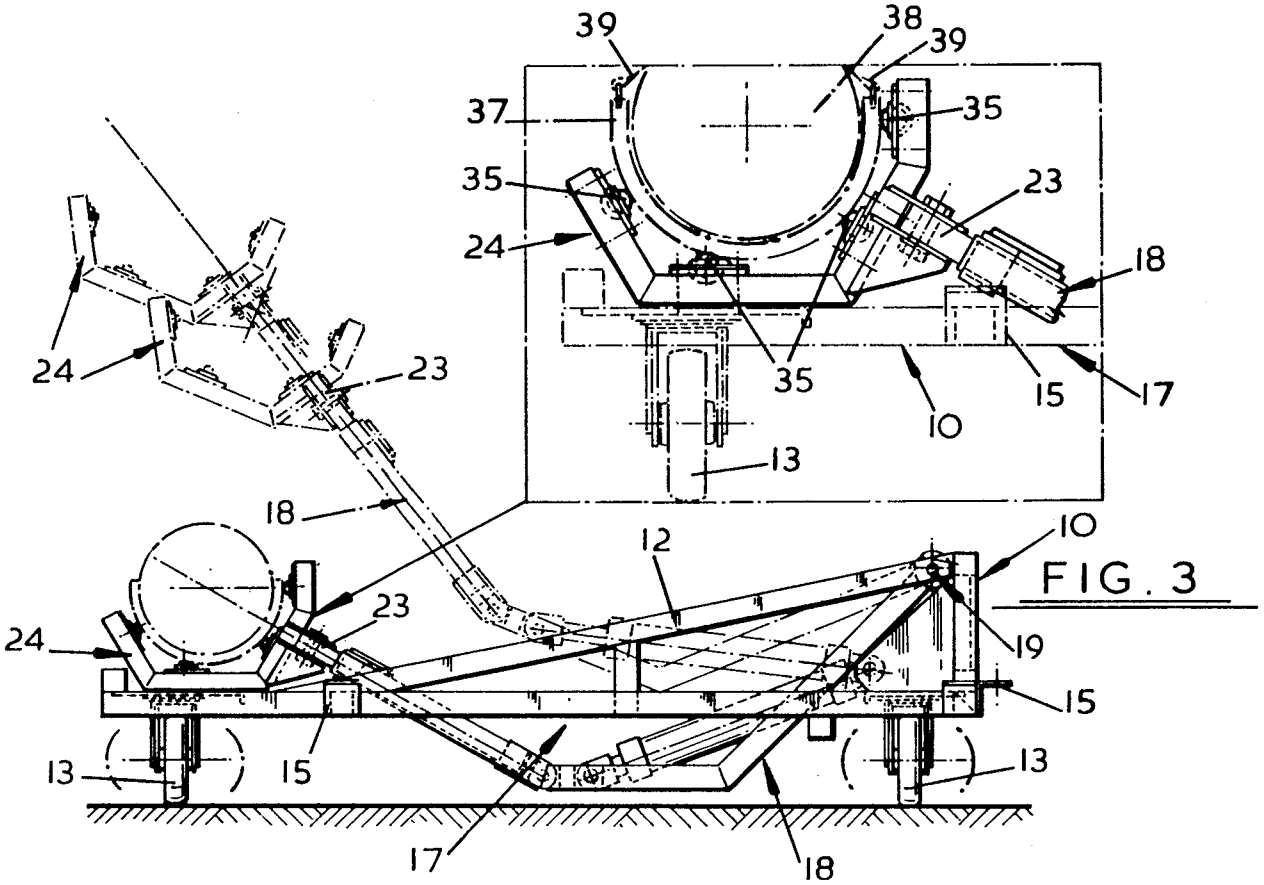
FIG. 3 is a corresponding side elevation.

Each side 17 of the support frame 10 is of rectangular configuration in plan view and mounts within it a support arm 18 pivotal about a horizontal axle 19. Each arm 18 comprises a pair of parallel tubes 18A, 18B which are of double cranked shape as can be seen in FIG. 3 to give the arm an extended, flat-bottomed V configuration.

A hydraulic cylinder is mounted between the tubes 18A, 18B of each arm 18. The cylinder 20 is a master cylinder while the cylinder 21 is a slave (displacement) cylinder.

Each cylinder 20 or 21 is connected to the support frame 10 at one end and to a cross pin 22 joining tubes 18A, 18B.

Within the tubes 18A, 18B of each arm 18 at the pivot axle remote end of the latter is a slidable extension 23 on which is fixed a support head 24.

A levelling or trimming hydraulic cylinder 25 or 26 connects a cross-pin 27 on each arm 18 and the corresponding slidable extension 23.

Figure 4:
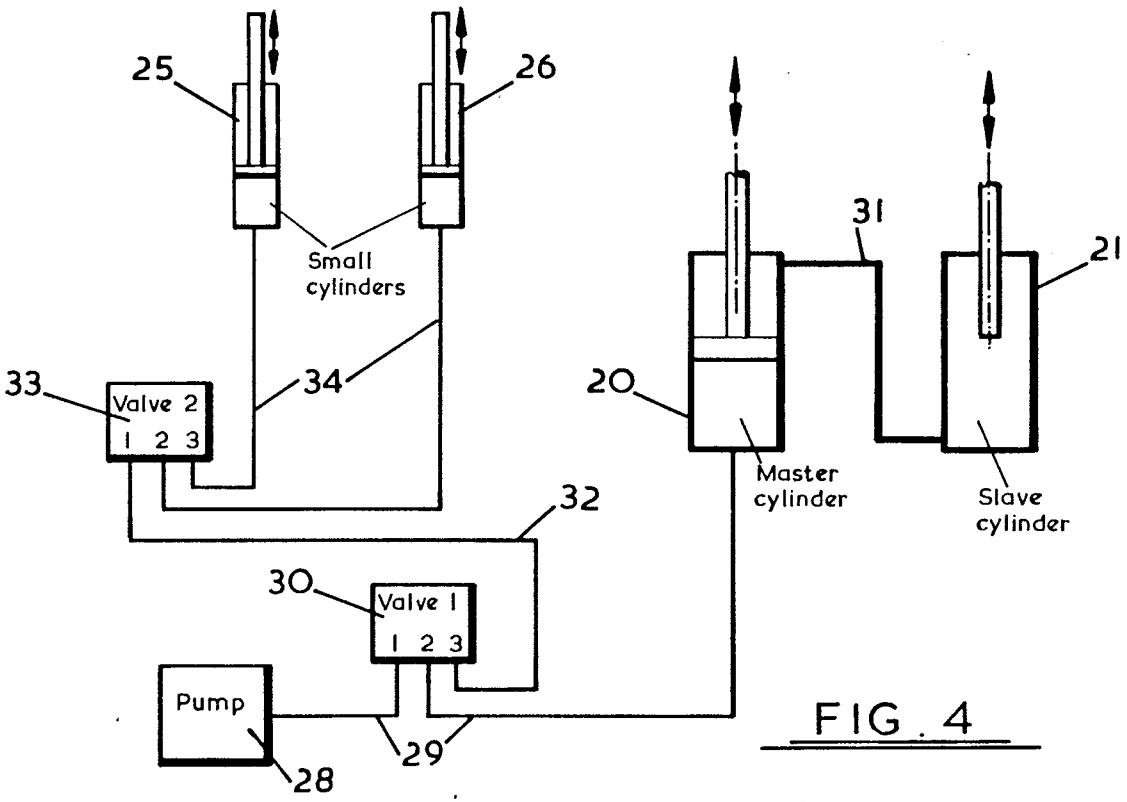
FIG. 4 is the hydraulic circuit of the load-handling apparatus.

On the closed end 14 of support frame 10 is mounted a combined pump with pressure relief and hydraulic fluid reservoir 28 (see FIG. 4) with the pump being manually operable. The pump/reservoir 28 is connected by convenient piping 29 through a manually-operable valve 30 to master cylinder 20 which is hydraulically connected via piping 31 to the slave cylinder 21, while the valve 30 is connected by piping 32 and a manually-operable selector valve 33 and piping 34 to the levelling cylinders 25, 26.

The pump/reservoir 28, valves 30 and 33 and piping will all be assembled and carried by the closed end 14 of the support frame 10.

Here it is to be noted that the support arms 18 are not mechanically coupled together. They are hydraulically coupled as will be manifest from the above.

Each support head 24 (see FIG. 3) is of semi-octagonal configuration in sid elevation and carries four ball supports 35.

Let us assume that all cylinders 20, 21, 25 and 26 are retracted. The support frame 10 is moved to straddle a trolley 36 on which is supported a semi-circular or semi-octagonal cradle 37 carrying a missile 38 secured in position by restraining straps 39.

The support heads 24 are located below the cradle 37, one at each side of the trolley 36 and the support arms 18 are elevated to allow the support heads 24 to lift the cradle 37 off the trolley 36. The trolley 36 is then removed and the support arms 18 are lowered to the full line position shown in FIG. 3.

Figure 5:
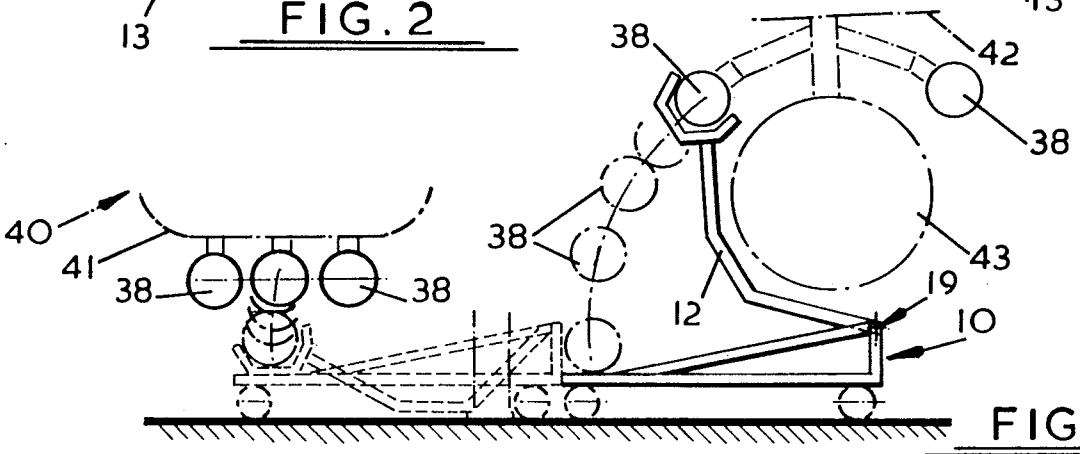
FIG. 5 is a diagrammatic view showing the presentation of missiles for attachment to an aircraft.

The support frame 10 is then moved to the aircraft 40 (FIG. 5) and if the missile 38 is to be attached to the underside of the fuselage 41 then the support arms 18 are raised a relatively short distance to present the fixing points of the missile 38 vertically to the fixing points on the fuselage 41.

If the missile 38 is to be fitted to fixing points on the aircraft wing 42 inboard of the usual large-diameter, disposable fuel tank 43 the support arms 18 are raised to present the missile fixing points at an angle of 45° to the angled fixing points on the wing 42. If the missile 38 is to be fitted to the fixing points outboard of the fuel tank 43 the support frame approach is simply reversed.

It will be noted that the geometry of the support arms 18 permit them to follow an arcuate path around the fuel tank 43 correctly to present the missile 38 for attachment.

It will be manifest that prior to fixing the missle 38 in position, restraining straps 39 are loosened to free the missile 38 from the cradle 37.

The ball supports 35 allow both rotational and longitudinal movements of the cradle 37 and missile 38 to locate the fixing points on the latter exactly relative to those on the aircraft.

Finally, levelling cylinders 25, 26 are brought into operation, if necessary, if, for example (due to uneven ground conditions) one end of the cradle and missile requires vertical adjustment relative to the other end.

I claim:

1. A load-handling apparatus, comprising: a low support frame, a pair of separate, side-by-side support arms cranked into a concave-upwards shape and pivoted at a first end on the support frame, hydraulic actuating means hydraulically linking the cranked support arms for synchronized vertical movement relative to the support frame about a common horizontal pivot axis, and load engaging means at a second end of each cranked support arm, a slidable extension being provided at the second end of each cranked support arm to support and carry the load engaging means, and the hydraulic actuating means comprising a self-contained hydraulic pump and hydraulic fluid reservoir on the support frame, a leveling hydraulic cylinder connecting each cranked support arm and its slidable extension, piping connecting the self-contained pump and the hydraulic fluid reservoir and the leveling cylinders, and first selector valve means associated with the piping and actuable to permit independent operation of the leveling cylinders to effect leveling of the disposition of the load-engaging means for correct presentation of the load when required.

2. Apparatus as claimed in claim 1, in which the hydraulic actuating means also comprises a master hydraulic cylinder connecting the support frame and a first cranked support arm, a slave hydraulic cylinder connecting the support frame and a second cranked support arm, the piping connecting the master and slave cylinders to the self-contained pump and hydraulic fluid reservoir, and a second selector valve means associated with the piping for delivering hydraulic fluid respectively to the master cylinder, the slave cylinder and the first selector valve means when required.

3. Apparatus as claimed in claim 1, in which each cranked support arm is double cranked so that in side elevation it has a stretched flat-bottomed V-configuration.

4. Apparatus as claimed in claim 1, in which the pump has a pressure relief valve for retraction of the cylinders.

5. Apparatus as claimed in claim 1, in which the pump is manually operated.

6. Apparatus as claimed in claim 1, in which the support frame is mounted on wheels.

7. Apparatus as claimed in claim 6, in which the wheels are castor wheels.

8. Apparatus as claimed in claim 6, comprising brake means to immobilize the support frame during a load engaging and lifting operation.

9. Apparatus as claimed in claim 8, in which the brake means comprises a pair of floor brakes.

10. Apparatus as claimed in claim 6, comprising at least one steering handle on the support frame.

11. Apparatus as claimed in claim 10, in which the at least one steering handle is detachable.

12. Apparatus as claimed in claim 1, in which the load engaging means is a support head carried by the slidable extension of each support arm and adapted partially to embrace a load.

13. Apparatus as claimed in claim 12, in which each support head is of semi-octagonal configuration.

14. Apparatus as claimed in claim 12, in which each support head incorporates rolling means to permit movement of the load relative to the support heads by an operator.

15. Apparatus as claimed in claim 14, in which the rolling means is a plurality of ball transfer units.

* * * * *